United States Patent [19]

Goldman, deceased et al.

[11] 4,361,128

[45] Nov. 30, 1982

[54] CARBURETOR INSERT APPARATUS

[76] Inventors: Harold Goldman, deceased, late of Riverdale, N.Y.; by Harriet Goldman, administrator, 3725 Blackstone Ave., Apt. 7-F, Riverdale, N.Y. 10463

[21] Appl. No.: 241,839

[22] Filed: Mar. 9, 1981

[51] Int. Cl.[3] ..... F02M 29/02

[52] U.S. Cl. ..... 123/592; 123/593

[58] Field of Search ..... 125/590, 592, 593

[56] References Cited

U.S. PATENT DOCUMENTS 2,659,667 11/1953 Bosdet ..... 123/592

3,946,717 3/1976 England ..... 123/592

FOREIGN PATENT DOCUMENTS 574245 3/1958 Italy ..... 123/593

982461 2/1965 United Kingdom ..... 123/591

*Primary Examiner*—Charles J. Myhre

*Assistant Examiner*—E. Rollins Cross

*Attorney, Agent, or Firm*—Arthur L. Plevy

[57] ABSTRACT

There is disclosed an insert for insertion between the carburetor and the firing chamber of the cylinders in an internal combustion engine. The insert comprises a cylindrical cup-like configuration having a plurality of rectangular apertures symmetrically positioned about the major sidewall and having a pattern of small apertures located on the bottom surface. First and second circular screen members are positioned within the insert to overlie the bottom surface, while a cylindrical screen member is positioned within the hollow of the insert to surround the major side surfaces containing the rectangular apertures.

8 Claims, 8 Drawing Figures

CARBURETOR INSERT APPARATUS

BACKGROUND OF THE INVENTION

This invention relates to apparatus for supplying a uniform and controlled flow of fuel to an internal combustion engine and more particularly relates to a carburetor insert for directing the stream of fuel and air emanating from the carburetor prior to introduction of the same to the cylinders of the engine.

The prior art describes a great many devices, which devices attempt to effect the air and gas mixture leaving the carburetor. These devices indicate that one can achieve an improvement in horsepower capability for the engine, while decreasig the pollutants and essentially improving efficiency. For examples of typical prior art devices, reference is made to U.S. Pat. No. 1,315,758 entitled Nebulizer for Hydrocarbon Engines issued on Sept. 9, 1919 to J. W. Brown. This patent shows a sleeve which is of a screen configuration which fits into a chamber leading into the cylinder and purportedly nebulizes fuel for more efficient combustion.

U.S. Pat. No. 1,394,820 entitled Mixing Device for Explosive Engines issued on Oct. 25, 1921 to J. H. Fritz also shows a screen device which is placed at the intake port of a cylinder and operates to mix the fuel and air.

U.S. Pat. No. 3,966,430 entitled Carburetor Adapter issued on June 29, 1976 to W. W. Stephens depicts an inserter which is positioned between the carburetor and the intake manifold. The patent describes a solid conical member which has a series of axial directed apertures through which the gas and air mixture leaving the carburetor is forced.

Other patents as U.S. Pat. No. 4,015,575 also describe an insert device which is used to concentrate fuel flow prior to introduction of the same into the engine. U.S. Pat. No. 4,114,580 entitled Distribution Rectifier for Inlet Manifold Systems issued on Sept. 19, 1978 to R. G. Coats depicts an insert device which is inserted in the carburetor and employed to atomize fuel and to vaporize the fuel before introduction of the same into the cylinders.

As one can ascertain from the above noted prior art, there are many devices depicted which purport to assure more uniform mixing of fuel and air and which operate in conjunction with the carburetor to accomplish the gaseous distribution. In any event, there are various problems associated with such devices. Certain of the devices of the prior art are extremely difficult to produce and to install.

Other devices do not supply an even distribution of the air and fuel mixture and tend to distribute fuel unevenly as the fuel emanates from the carburetor. In general, many of these devices have never been employed as they suffer from various problems.

It is therefore an object of the present invention to provide an improved carburetor insert device, which device serves to increase engine efficiency and therefore results in a substantial fuel savings, while further assuring that there is an even flow pattern of fuel emanating from the carburetor which results in a uniform distribution to the cylinders of the automobile.

BRIEF DESCRIPTION OF THE PREFERRED EMBODIMENT

In a carburetor system for an internal combustion engine, which engine includes a carburetor for supplying a mixture of fuel and air to said engine, the combination therewith of an insert situated after said carburetor and positioned between the carburetor and the engine, said insert comprising a cup-like cylindrical member having an open top surrounded by a peripheral flange, a major sidewall surface having located thereon regularly spaced rectangular apertures, with said apertures occupying a substantial portion of the total area of said surface, a bottom surface having a plurality of circular apertures each of a relatively small diameter and arranged in concentric circles about a central aperture, at least one circular screen member inserted within the hollow of said insert and overlying said bottom surface and a cylindrical screen member having an opened top and an opened bottom inserted within the hollow of said insert and overlying said rectangular apertures.

DETAILED DESCRIPTION OF THE INVENTION

Figure 1:
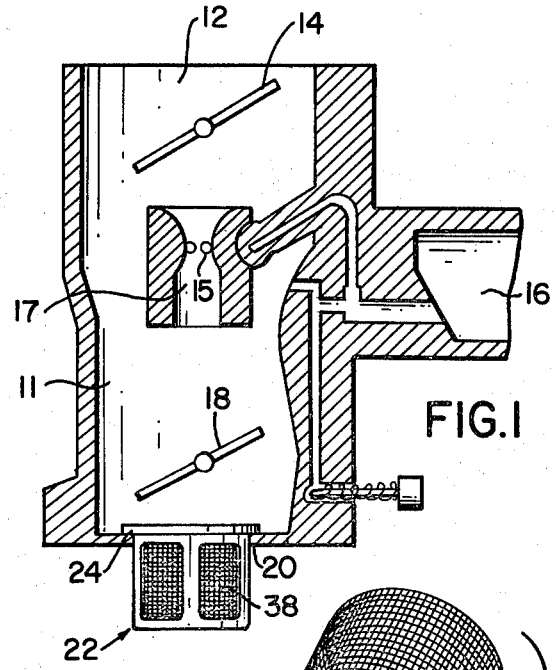
FIG. 1 is a side sectional view of the insert of this invention employed in a carburetor.

Referring to FIG. 1, there is shown a cross sectional view depicting a typical structure of a carburetor normally employed in a conventional internal combustion engine. In general, the carburetor includes a main chamber 11 which operates to conduct a stream of air and fuel to the engine. The carburetor possesses a top opening 12 which is normally coupled to an air filter and operative to introduce air into the carburetor. The carburetor is also associated with an adjustable valve or choke 14 operative to control the amount of air.

A venturi structure 14 is normally located in the main chamber 11 and functions to accelerate the flow of air as well as to reduce the pressure of air flow in the chamber. The carburetor is normally associated with fuel inlet ports such as 15 where fuel mixes with the air in the venturi to automatically draw fuel from the gas tank or fuel reservoir 16. Downstream from the venturi structure there is located a throttle valve plate 18 which is pivotable so as to allow an adjustment of the volume of fuel and the airstream entering the engine.

The operation of the above described components is well known and is part and parcel of most conventional carburetor systems presently in use.

Located beneath the throttle 18 is an opening 20 which permits air and fuel emanating from the carburetor to be directed to the cylinders of the engine. Interposed in the opening 20 is a carburetor insert device 22 according to this invention. The carburetor insert device 22 is a cup-like member having a top circular flange 24 with a portion of the periphery of the flange removed as will be further explained. The carburetor insert has the appearance of a cup and has five rectangular apertures 25 positioned about the side peripheral surface. The bottom surface of the insert 22 has a plurality of apertures which are positioned about the center in four concentric circular configurations. Positioned within the isert 22 is a circular screen member which is of a diameter essentially equal with the inner diameter of the insert 22 and overlies the rectangular openings in the side surface. Two additional screen members are inserted in the bottom of the insert 22 as will be further explained.

Figure 2:
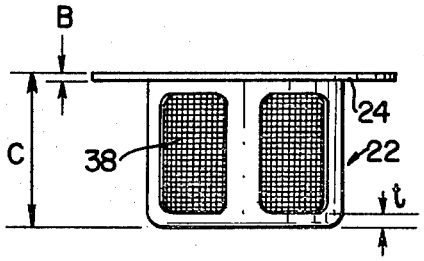
FIG. 2 is a side view of the insert.

Referring to FIG. 2, there is shown a side view of the insert 22 with a circular screen member 26 visible through the side rectangular apertures 25.

Figure 3:
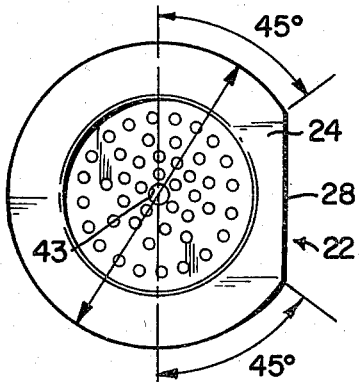
FIG. 3 is a top plan view.
Figure 4:
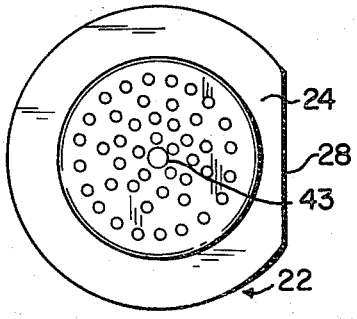
FIG. 4 is a bottom plan view.

FIG. 3 depicts a top view of the insert 22 showing the squared off portion of the top flange 25. Also visible in FIG. 3 is the aperture configuration on the bottom surface.

Figure 5:
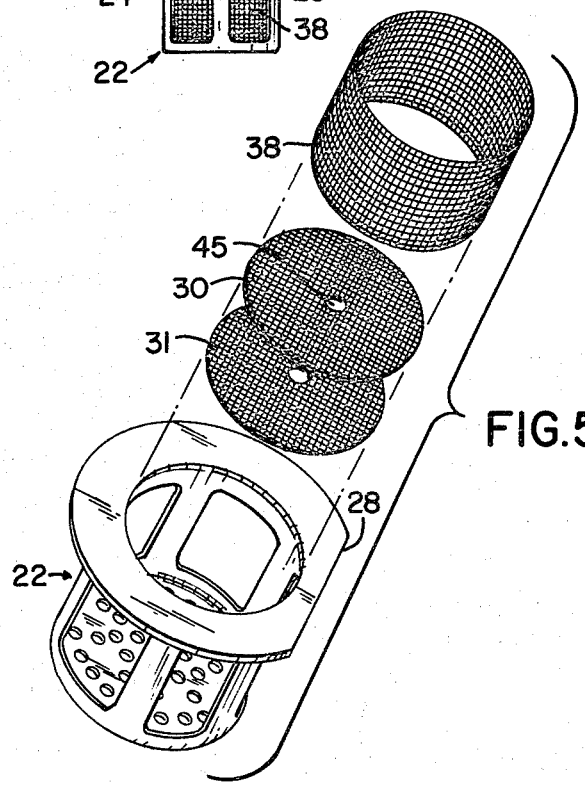
FIG. 5 is a perspective assembly view of the insert.

Referring to FIG. 5, there is shown an assembly view depicting the assembly configuration of the insert 22. As one can ascertain from FIG. 5, two circular screen meshes as 30 and 31 are inserted to overlie the bottom apertured surface of the insert. After insertion of members 30 and 31, the cylindrical screen member 28 is then inserted into the insert.

Figure 6:
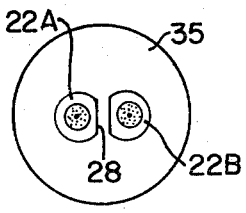
FIG. 6 is a top plan view of a carburetor base employing two inserts according to this invention.

FIG. 6 is a top plan view of a dual barrel carburetor 35. Essentially, such a carburetor has two openings as 20 to allow the air and fuel mixture from the carburetor to be introduced into the cylinders. In order to employ two inserts as 22A and 22B, one positions the squared off flange sections as 28 adjacent each other to allow the dual barrel carburetor to accommodate both inserts. It is, of course, understood that due to the nature of the flange configuration as flange 25, one can incorporate the insert in single, double or multi-barrel carburetors.

Figure 7:
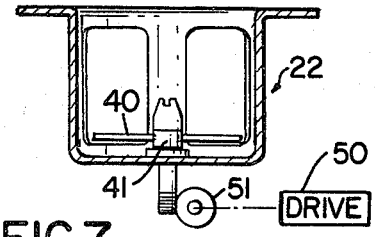
FIG. 7 is a partial side sectional view of an insert employing a fan assembly.

Referring to FIG. 7 there is shown a partial cross sectional view of an insert such as 22 having positioned thereon an impeller or fan blade 40.

Figure 8:
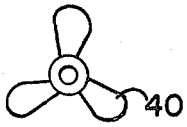
FIG. 8 is a top plan view showing the blade configuration of the fan assembly.

FIG. 8 depicts the fan blade 40, which essentially has a small blade inclination of about 15°. The fan assembly is rotatably supported on a shaft 41 which is positioned within and through the central aperture 43 of the bottom surface and the apertures as 45 of the bottom screen members 30 and 31. The fan may be directly driven by means of a miniature belt coupled to a suitable drive mechanism 51 or may be directly driven by a motor via the vehicle's battery.

Essentially, the fan is positioned within the internal cavity of the insert 22. The fan blades, as indicated, have a slight inclination with respect to the horizontal axis of about 15° and when operated, cause a turbulence within the carburetor insert to more uniformly distribute the air and fuel mixture emanating from the carburetor. The insert 22 is formed from brass stock approximately 1/16" thick. In this manner brass, being a good conductor of heat, causes the insert to assume a temperature indicative of engine temperature. The heat stored by the insert provides for further vaporization of the fuel and air mixture prior to introduction of the same in the carburetor.

Referring to FIG. 3, various dimensions of the unit will be further described. The diameter A of the flange is 2". The inner diameter of the opening and hence, the diameter of the bottom surface is $1\frac{1}{4}$". The truncated portion of the top flange is cut at an angle of 45° from a vertical diameter extending through the center 43.

Referring to FIG. 2, the width of the flange B is approximately 1/16", while the height of the insert C is 15/16". The square apertures are positioned approximately 5/32" above the bottom surface and are approximately 9/16" in width and approximately $\frac{5}{8}$" in height.

As indicated, there are five apertures as 25 spaced around the outer peripheral surface of the insert. The holes in the bottom surface are arranged in four concentric circles as shown. There is a center hole 43 surrounded by five holes in the first row which in turn are surrounded by a second ring surrounded by ten holes, a third ring of ten holes and an outer ring of twenty holes. The holes in the third row are interposed between the holes in the second and fourth rows.

The screens 30 and 31 are approximately 1 13/16" diameter with a central hole as 45 of $\frac{1}{8}$" in diameter. Both the screens 30 and 31 as well as the circular screen 28 are fabricated from conventional wire screen mesh such as that used and employed in window screens.

When the insert 22 is positioned within the carburetor aperture 20, it serves to provide a unique turbulence pattern which assures the equal distribution of fuel to the engine and therefore to each cylinder. The inserts thus described, when employed in conventional engines with conventional carburetors, result in a ten percent decrease in fuel consumption. A vehicle utilizing the insert further exhibits superior acceleration and operating response. The flow pattern provided by the insert assures a completely efficient mixture of fuel and air to the engine. As one can ascertain, the insert provides a more restrictive flow due to the aperture pattern in the bottom surface, whereby each aperture is 1/16" in diameter. The side portions of the insert comprise the five rather large holes; each hole separated by the central bar which is 7/32" in width. Hence, the flow from the side of the device is less restrictive than the flow from the bottom. In this manner, a turbulence pattern is created along the entire outer surface of the insert, which pattern directs fuel and air to the engine in an efficient manner.

In the embodiment shown in FIG. 7, the rotatable fan further can operate, depending upon the speed of the rotation, to vary the pattern and hence, provide a more efficient operation. Variation of the pattern can be achieved by varying the speed of the fan and hence, one can alter the flow pattern to the engine by so doing.

It is, of course, understood that because a major portion of the insert is fabricated from brass, the insert also serves to retain heat and hence, to further assure a homogeneous distribution of the air and fuel mixture to the engine.

While the invention has been disclosed and described in the above described specification, the examples are illustrative and other modifications of the apparatus are deemed to be within the scope and breadth of the invention as claimed.

It is claimed:

1. In a carburetor system for an internal combustion engine, which engine includes a carburetor for supplying a mixture of fuel and air to said engine, the combination therewith of an insert situated after said carburetor and positioned between the carburetor and the engine, said insert comprising a cup-like cylindrical member having an open top surrounded by a peripheral flange, a major sidewall surface having located thereon regularly spaced rectangular apertures, with said apertures occupying a substantial portion of the total area of said surface, a bottom surface having a plurality of circular apertures each of a relatively small diameter and arranged in concentric circles about a central aperture with said circular apertures located about said central aperture in at least four concentric circular patterns with the apertures in the third circular pattern located between the apertures in the second and fourth pattern, first and second circular screen members inserted within the hollows of said insert and overlying said bottom surface with said screen members being moveable with respect to one another and with respect to said bottom surface and a cylindrical screen member having an opened top and an opened bottom inserted within the hollow of said insert and overlying said rectangular apertures.

2. The combination according to claim 1 wherein said cup-like cylindrical member is fabricated from a heat conducting metal to retain heat developed by said engine.

3. The combination according to claim 1 further including:

a fan blade assembly rotatably mounted in the hollow of said insert and extending upwardly from said bottom surface.

4. The combination according to claim 1 including a flat truncated section located on said flange.

5. The combination according to claim 1 further including means coupled to said fan blade assembly for rotating the same.

6. The combination according to claim 5 wherein each blade of said fan blade assembly has a tilt of fifteen degrees with respect to the horizontal.

7. The combination according to claim 2 wherein said metal is brass.

8. The combination according to claim 1 wherein said first circular pattern contains five circular apertures each approximately of the same diameter, said second circular pattern containing ten circular apertures of the same diameter as said first, said third pattern containing ten circular apertures of the same diameter, and said fourth circular pattern containing twenty circular apertures of the same diameter as the others with five rectangular slots on said sidewall surface.

* * * * *